US010593155B2

(12) United States Patent
Nakamura

(10) Patent No.: US 10,593,155 B2
(45) Date of Patent: Mar. 17, 2020

(54) INFORMATION-PROCESSING SYSTEM, INFORMATION-PROCESSING DEVICE, STORAGE MEDIUM, AND ELECTRONIC MONEY CHARGING METHOD

(71) Applicant: NINTENDO CO., LTD., Kyoto (JP)

(72) Inventor: Daisuke Nakamura, Kyoto (JP)

(73) Assignee: NINTENDO CO., LTD., Kyoto (JP)

( * ) Notice: Subject to any disclaimer, the term of this patent is extended or adjusted under 35 U.S.C. 154(b) by 463 days.

(21) Appl. No.: 14/715,925

(22) Filed: May 19, 2015

(65) Prior Publication Data

US 2015/0347994 A1 Dec. 3, 2015

(30) Foreign Application Priority Data

May 29, 2014 (JP) ..... 2014-111420

(51) Int. Cl.
*G07F 17/32* (2006.01)

(52) U.S. Cl.
CPC ..... *G07F 17/3244* (2013.01)

(58) Field of Classification Search
CPC ..... G07F 17/3244
See application file for complete search history.

(56) References Cited

U.S. PATENT DOCUMENTS 7,890,381 B1 * 2/2011 Lyskovsky ..... G06Q 30/02 705/26.8
2006/0068898 A1 * 3/2006 Maya ..... G07F 17/32 463/25
2009/0299844 A1 * 12/2009 Reilly ..... G06Q 20/06 705/14.27
2009/0328158 A1 * 12/2009 Ollila ..... G06Q 10/06 726/4

FOREIGN PATENT DOCUMENTS

JP 2000-0167246 6/2000
JP 2014-74968 4/2014

OTHER PUBLICATIONS

Nicholson, Brad, "Pre-Load Cash Into Your Steam Account With the Steam Wallet", Giant bomb News, Sep. 13, 2010. (Year: 2010).*
Humphries, Matthew, "Valve starts public beta for Steam Wallet", Geek.com, Sep. 14, 2010. (Year: 2010).*
"Limited account", Steam Forums discussion, Mar. 23, 2014. (Year: 2014).*
"Free-to-Play and Free-to-Play Games on Steam", Steam Support, Apr. 3, 2014. (Year: 2014).*
Notification of Reasons for Refusal in JP Patent Application No. 2014-111420 (with translation), 4 pages, dated Jul. 3, 2018.
Baseball Heroes, Dengeki Arcade Game, vol. 26, 11 pages, 2011.

* cited by examiner

*Primary Examiner* — Eric T Wong
(74) *Attorney, Agent, or Firm* — Xsensus LLP

(57) ABSTRACT

An exemplary information-processing system includes at least a receiving unit (11) that receives a charge of electronic money usable in a predetermined payment system, a game control unit (12) that makes a game processing executable in response to the receipt of the charge by the receiving unit (11), and a balance control unit (15) that adds an amount of the charge received by the receiving unit (11) to a balance, without decreasing the balance in response to execution of the game processing.

22 Claims, 4 Drawing Sheets

INFORMATION-PROCESSING SYSTEM, INFORMATION-PROCESSING DEVICE, STORAGE MEDIUM, AND ELECTRONIC MONEY CHARGING METHOD

CROSS REFERENCE TO RELATED APPLICATIONS

The disclosure of Japanese Patent Application No. 2014-111420, filed on May 29, 2014, is incorporated herein by reference.

FIELD

The exemplary embodiment relates to electronic money charging.

BACKGROUND AND SUMMARY

Known in the art is a game in which electronic money is consumed before or during play. Widely known in the art is a technique for charging prepaid type electronic money to a medium.

An exemplary embodiment provides an information-processing system including a receiving unit, a balance control unit, and a game execution unit. The receiving unit receives a charge of electronic money usable in a predetermined payment system. The balance control unit adds an amount of the charge received by the receiving unit to a balance. The game execution unit executes a predetermined game processing in response to the receipt of the charge by the receiving unit, without decreasing the balance.

DETAILED DESCRIPTION OF NON-LIMITING EXAMPLE EMBODIMENTS

Example Embodiment

Figure 1:
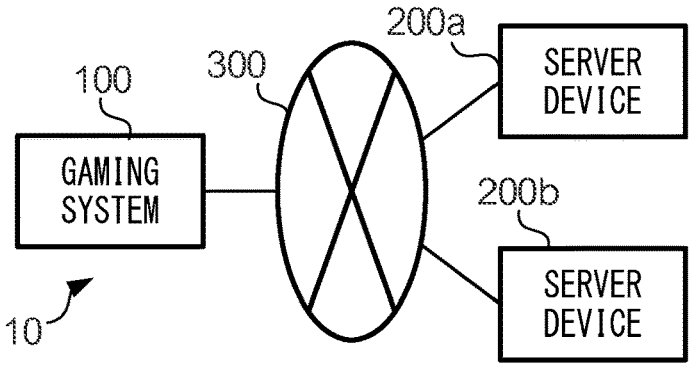
FIG. 1 shows an example configuration of an information-processing system.

FIG. 1 is a block diagram showing a configuration of information-processing system 10 according to the present exemplary embodiment. Information-processing system 10 includes gaming system 100 and server devices 200*a* and 200*b*. Gaming system 100 and server devices 200*a* and 200*b* are coupled via network 300, which enables them to communication with each other. Though not shown in FIG. 1, information-processing system 10 may include plural gaming systems 100.

Information-processing system 10 is a system for enabling a user to play a game by spending electronic money. A user is able to play a game by use of information-processing system 10. Server devices 200*a* and 200*b* are computer devices for managing a user's electronic money. Server devices 200*a* and 200*b* are referred to as "server device 200," except where it is necessary to specify otherwise. Network 300 is a communication network such as the Internet or a mobile communication network. Network 300 may be a complex network including plural interconnected communication networks.

Electronic money herein refers to a monetary value represented by digital data, which can be used in a predetermined payment system. A user is able to convert currency such as yen or dollar to electronic money to purchase a product or service. A product herein may be tangible goods or digital content such as a data file or an application program. A unit of electronic money may be an original unit different from the currency unit from which it is converted. In the present exemplary embodiment, the Japanese currency unit "yen" is used as a unit of electronic money.

Figure 2:
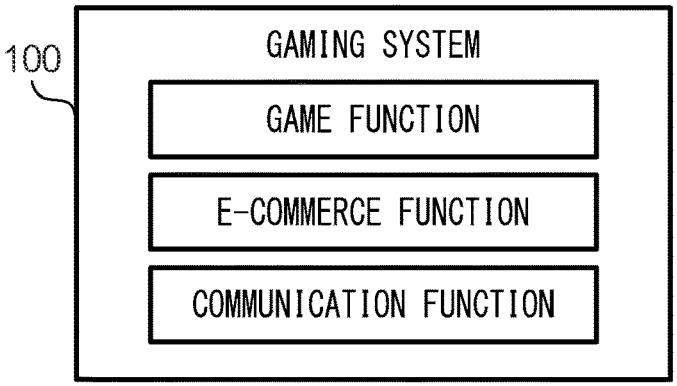
FIG. 2 shows example of main functions of a gaming system.

FIG. 2 is a block diagram showing main functions of gaming system 100. Gaming system 100 includes a game function, an e-commerce function, and a communication function. The game function is a function for executing a game processing, and specifically a function for receiving a user's input operation and executing a game program in accordance with the input operation. The e-commerce function is a function for purchasing a product or service by use of electronic money. A virtual store or online store, which is accessible to a user using gaming system 100, and its payment system are hereinafter referred to as an "e-shop." Products and services available in an e-shop may be used inside or outside gaming system 100. The communication function is a function for enabling communication with a user of another gaming system 100. Communication herein may include a message exchange using text or images, or a voice or video chat.

The functions of gaming system 100 may cooperate with each other. A user may purchase a downloadable content (DLC) relevant to a game being played, or exchange messages with another user after playing a competitive or cooperative game with him/her.

Figure 3:
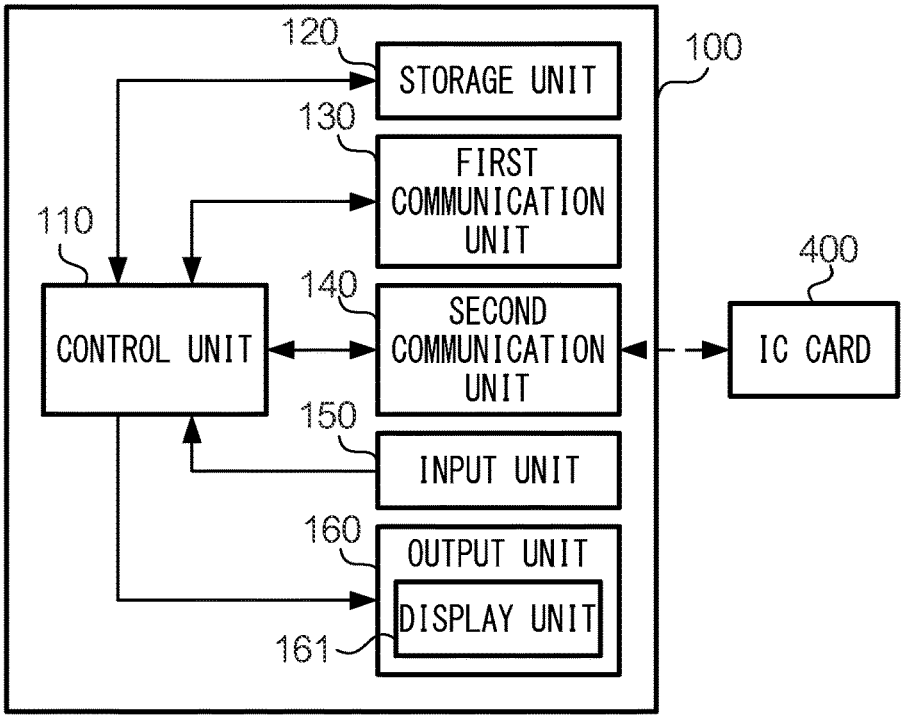
FIG. 3 shows an example of a hardware configuration of a gaming system.

FIG. 3 is a block diagram showing a hardware configuration of gaming system 100. Gaming system 100 includes at least control unit 110, storage unit 120, first communication unit 130, second communication unit 140, input unit 150, and output unit 160. Output unit 160 includes display unit 161.

Control unit 110 is a unit for controlling components of gaming system 100. Control unit 110 includes a processing unit such as a central processing unit (CPU) and a main memory, and controls operations of the components by executing programs. Control unit 110, in the present exemplary embodiment, executes programs for providing the game function, the e-commerce function, and the communication function.

Control unit 110 may include plural processors to execute distributed processing. Control unit 110 may cause the processors to share processes executed concurrently. Control unit 110 may, specifically, cause a processor to execute a game processing, while causing another processor to control communication with an external device.

Storage unit 120 is a unit for storing data. Storage unit 120 includes a storage medium such as a hard disk, and stores data such as a program, used by control unit 110. Storage unit 120 may include a removable storage medium such as an optical disk or a memory card, and a reader/writer for reading and writing data from/in the storage medium. Game programs stored in storage unit 120 may be pre-written or pre-installed in storage unit 120, or downloaded via first communication unit 130 from an external device.

Storage unit 120, in the present exemplary embodiment, stores user information. Each item of user information is data associated with a user, which may include account information such as an ID or a password, necessary for login, or user attribute information such as a name, a birth date, or gender. User information may alternatively include data associated with a game, such as data saved using a saving function, or data on items used by a user in a game.

First communication unit 130 and second communication unit 140 are units for sending and receiving data. First communication unit 130 exchanges data with server device 200 or another gaming system 100 via network 300. Second communication unit 140 exchanges data with IC card 400. Second communication unit 140 communicates with IC card 400 in conformity with a predetermined standard. Second communication unit 140 may perform non-contact wireless communication such as near field communication (NFC) defined in ISO/IEC 18092. Second communication unit 140 is specifically a reader/writer capable of communicating with IC card 400.

IC card 400 is a card-type medium with an integrated circuit (IC), which is referred to as "smart card" or "chip card." IC card 400 is an electronic-payment-capable medium with an electronic money function, which may be used as a ticket in a payment system. IC card 400 is capable of transferring electronic money by communicating with second communication unit 140.

An electronic money transfer in the present example embodiment refers to changing electronic money usable in a payment system to that usable in another payment system, and specifically to converting electronic money circulating in a payment system using IC card 400 to that circulating in information-processing system 10. An action for making electronic money associated with IC card 400 usable in an e-shop described above is hereinafter referred to as "charging." A user is able to charge electronic money by passing IC card 400 over second communication unit 140.

Input unit 150 is a unit for receiving a user's input of information. Input unit 150 may include a controller or joystick operated by a user. Input unit 150 may alternatively include a microphone to receive a user's vocal input, or may receive an input from a range image sensor, or specifically 3D sensor, or motion sensor to receive a gesture input using a body or hand.

Output unit 160 is a unit for outputting information provided to a user. Display unit 161 is a unit for outputting visual information in particular, and is specifically a display device using display elements such as liquid crystals. Output unit 160 may output a voice via a speaker or headset, or may perform different notifications to a user by lighting or blinking a lamp, or activating a vibrator. Display unit 161 may be a touch-screen display, which includes the function of input unit 150.

Gaming system 100 may be a single device including the components, or a combination of plural devices among which the components are distributed. Gaming system 100 may be formed by a combination of a main body including control unit 110, storage unit 120, and first communication unit 130, a TV receiver corresponding to output unit 160, and an input device such as a controller or a keyboard, including second communication unit 140 and input unit 150. Gaming system 100 may alternatively be formed by a combination of a game machine not including second communication unit 140, and a reader/writer for IC card 400, connected to the game machine, which functions as second communication unit 140.

Server devices 200*a* and 200*b* manage electronic money for a predetermined payment system, respectively. A payment system managed by server device 200*a* is hereinafter referred to as "first payment system," and a payment system managed by server device 200*b* is hereinafter referred to as "second payment system." The first payment system deals with electronic money associated with IC card 400, and the second payment system deals with electronic money usable in an e-shop. Server devices 200*a* and 200*b* have an electronic money management function in common, although they store different data.

Figure 4:
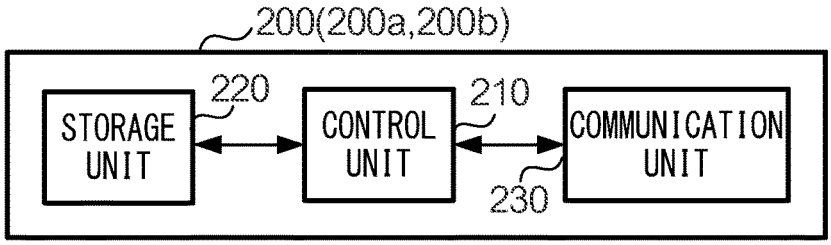
FIG. 4 shows an example of a hardware configuration of a server device.

FIG. 4 is a block diagram showing a hardware configuration of server device 200. Server device 200 includes control unit 210, storage unit 220, and communication unit 230. Control unit 210 is a unit for controlling operations of components of server device 200, which unit may include a CPU. Storage unit 220 is a unit for storing data used by control unit 210. Communication unit 230 is a unit for communicating with gaming system 100 via network 300.

Storage unit 220 stores balance information of users. Each item of balance information herein refers to data indicative of a user's balance of electronic money usable in a payment system. A balance indicated by balance information, in the case of the second payment system, increases if a user charges electronic money, and decreases if a user makes a purchase in an e-shop, or by online shopping. Server device 200*a* stores balance information for the first payment system, and server device 200*b* stores balance information for the second payment system.

The foregoing is a description of a configuration of information-processing system 10. With thus configured information-processing system 10, a user is able to play a game or exchange messages with another user. A user is also able to make a purchase in an e-shop as needed. When doing so, a user may use electronic money for different uses. A user may, specifically, purchase and download a game program executable in gaming system 100, or purchase a DLC when playing a game. Electronic money according to the present exemplary embodiment has a wide variety of uses.

Before making a purchase in an e-shop a user has to prepare a balance, whose amount is equal to or greater than the purchase amount. A user is able to charge electronic money by use of IC card 400 to increase the balance. A user may charge electronic money at any time. A user may charge a necessary amount of electronic money immediately before making a purchase, or may charge general-purpose electronic money for saving.

Gaming system 100 makes a predetermined game processing executable in response to a user's charging of electronic money. The game is different from games sold in an e-shop in that the game is not purchased by a user using electronic money. The game has a feature whereby a user's action of charging electronic money makes the game playable. The game is hereinafter referred to as a "mini game" to distinguish it from other games. A mini game program may be pre-stored in storage unit 120, or may be downloaded from server device 200 when a first charging of electronic money is performed.

A mini game may be of any type or genre. A mini game may be a game simple enough to be played by anyone, which requires a relatively short time to complete. A mini game, in the present example embodiment, is a game of putting a coin in a coin bank having a structure like a pinball board or a smart-ball board. The mini game can be played 30 times, using 30 coins awarded each time a user charges electronic money to a value of 100 yen. The mini game has plural stages, each of which has a mission assigned to be accomplished to enable playing of the next stage.

Figure 5:
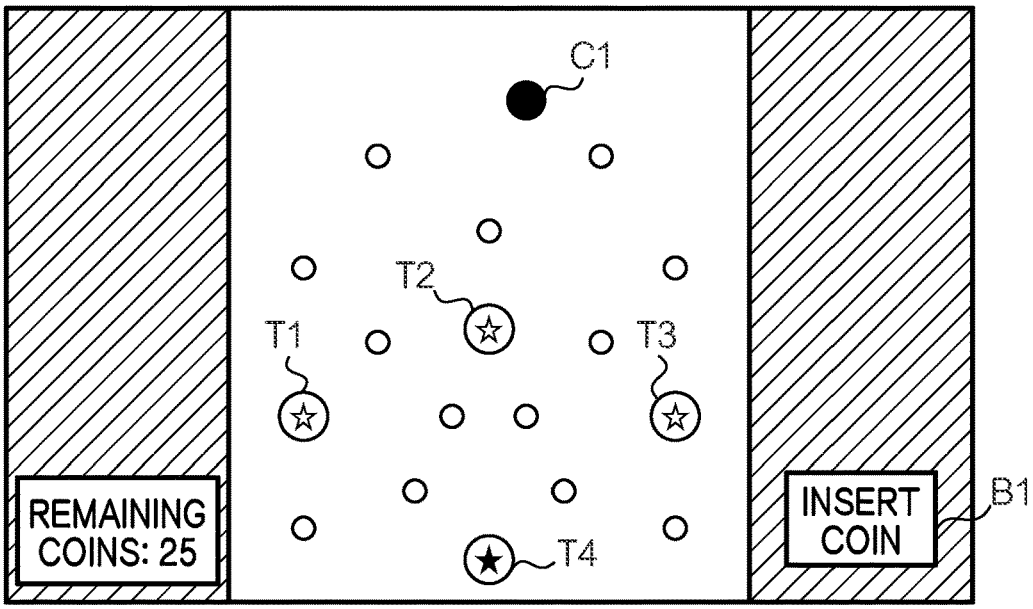
FIG. 5 shows an example of a display screen showing a stage of a mini game.

FIG. 5 is a diagram showing an example display screen showing a stage of the mini game. Coin C1 shown in the screen falls from top to bottom with its direction of movement being changed by pins. Reference symbols T1, T2, T3, and T4 shown in the drawing indicate targets. A user is able to drop coin C1 one after another at a desired position of the top of the screen by selecting insert button B1. Hitting all targets T1 to T3 using coins C1 clears the stage.

Target T4 is a target for obtaining a bonus. Hitting target T4 using coin C1 provides a user with a predetermined bonus. A bonus, in the present exemplary embodiment, may be image data representing a stamp that can be attached to a message exchanged using the communication function, which bonus neither increases nor decreases a balance of electronic money. A bonus may be a content usable in a game different from the mini game.

Figure 6:
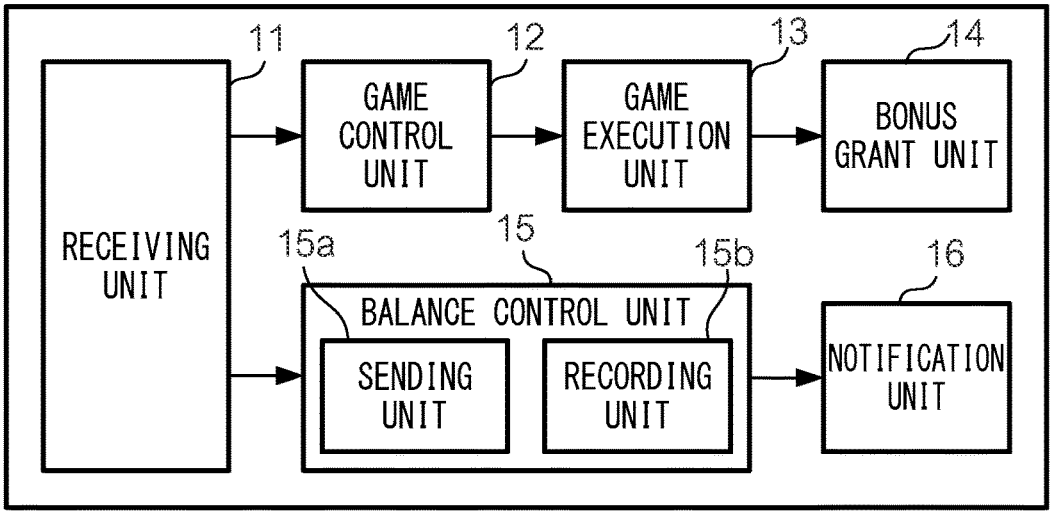
FIG. 6 shows an example of a functional configuration of an information-processing system.

FIG. 6 is a block diagram showing a functional configuration to enable the charging and the mini game. Information-processing system 10 provides receiving unit 11, game control unit 12, game execution unit 13, bonus grant unit 14, balance control unit 15, and notification unit 16. Balance control unit 15, specifically, includes sending unit 15*a* and recording unit 15*b*.

The configuration shown in FIG. 6 is enabled by cooperation of gaming system 100 and server device 200 in the present exemplary embodiment. Specifically, recording unit 15*b* is enabled by server device 200, and the other units are enabled by gaming system 100 in the present exemplary embodiment.

Receiving unit 11 is a unit for receiving an electronic money charge. Receiving unit 11, in the present example embodiment, receives an electronic money charge through communication performed by second communication unit 140 with IC card 400. Receiving unit 11 receives a charging of an amount according to a user's input operation. Electronic money may be charged in units of one yen; however, it is charged in units of 100 yen in the present example embodiment. Receiving unit 11 may confirm a balance of electronic money recorded in IC card 400, and reject charging when the balance is insufficient.

Game control unit 12 is a unit for controlling execution of a mini game. Game control unit 12 makes a game processing of a mini game executable in response to receipt by receiving unit 11 of an electronic money charge. In other words, game control unit 12 prohibits execution of a game processing of a mini game prior to an electronic money charge, and permits execution of a game processing of a mini game in response to an electronic money charge. Game control unit 12 may not execute a game processing for a user who does not wish to play a mini game.

Game control unit 12, in the present exemplary embodiment, permits times of execution of a game processing, the times depending on an amount of charged electronic money. Game control unit 12 may, specifically, permit 30 executions of a game processing in exchange for 100 yen. Game control unit 12 makes a game processing executable more times in proportion to an amount of charge or a number of charges.

Game execution unit 13 is a unit for executing a game processing of a mini game. Game execution unit 13 executes a game processing under control of game control unit 12. Game execution unit 13, specifically, executes a game processing of a mini game when permitted by game control unit 12. In other words, game execution unit 13 executes a game processing in response to receipt by receiving unit 11 of an electronic money charge.

Bonus grant unit 14 is a unit for granting a bonus to a user. Bonus grant unit 14 grants a bonus according to a result of a game processing executed by game execution unit 13. Bonus grant unit 14, specifically, grants a bonus according to a predetermined condition satisfied by a user in a mini game. A bonus granting processing may be a processing for making a content such as a stamp, prepared as a bonus, usable for a user by downloading.

A bonus, in the present example embodiment, neither increases nor decreases a balance of electronic money. Bonus grant unit 14 may not increase a balance of electronic money when a user satisfies a predetermined condition in a mini game. However, a bonus that increases a balance of electronic money is not impossible technically, and may be included in the technical scope of the present example embodiment.

Balance control unit 15 is a unit for controlling a balance of electronic money. Balance control unit 15, when a charge of electronic money to an e-shop is made, decreases a balance in the first payment system and increases a balance in the second payment system. Balance control unit 15, when a user makes a purchase in an e-shop, decreases a balance in the second payment system. Specifically, sending unit 15*a*, when a user charges or consumes electronic money, sends data indicative of an increased or decreased amount to server device 200 in gaming system 100. In server device 200, recording unit 15*b* updates balance information based on the data sent by sending unit 15*a* to record an increase or decrease of a balance.

Balance control unit 15, in the present example embodiment, adds an amount of a charge received by receiving unit 11 to a balance for the second payment system, without decreasing the amount due to a game processing executed by game execution unit 13. Balance control unit 15 may add to a balance the same amount as that of a charge received by receiving unit 11. Balance control unit 15 may alternatively add an amount larger than that of a charge received by receiving unit 11 to a balance. Balance control unit 15 may, specifically, add to a balance an amount of a charge received by receiving unit 11, together with a predetermined extra amount, or may add to a balance the amount of a charge with an additional predetermined percentage, when a predetermined condition is met, or specifically during a campaign.

Balance control unit 15 increases a balance independently of a game processing executed by game execution unit 13, or namely, regardless of a result of the executed game processing. Balance control unit 15 may therefore increase a balance prior to, subsequent to, or parallel to execution of a game processing by game execution unit 13. It is to be noted that balance control unit 15 may reflect an amount charged by a user in server device 200 immediately in an environment where gaming system 100 has constant access to network 300, whereas in a case where a charging is received when gaming system 100 is offline, or namely gaming system 100 has no access to network 300, balance control unit 15 may increase a balance subsequent to connection of gaming system 100 to network 300.

Figure 7:
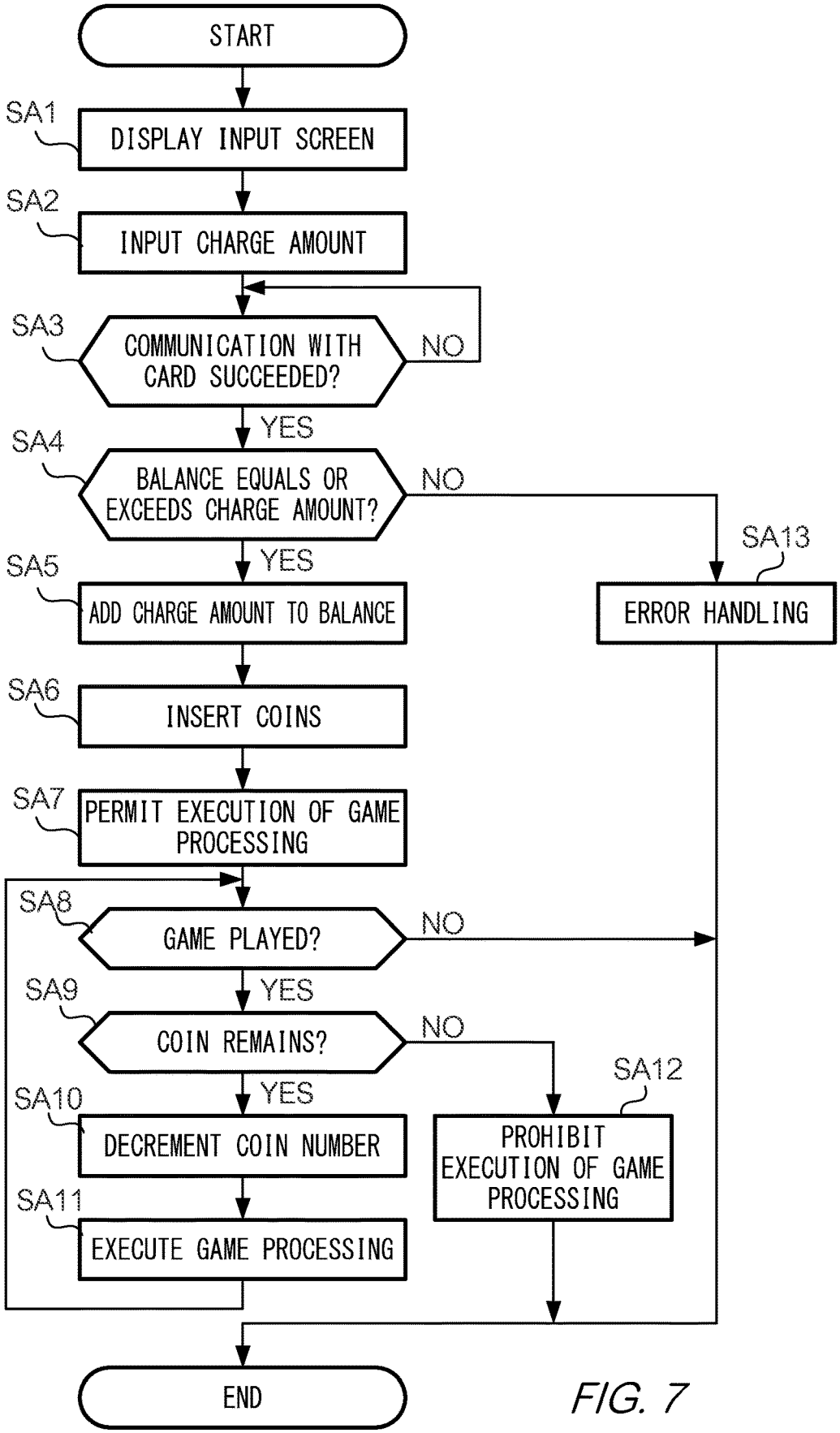
FIG. 7 shows an example of a flowchart illustrating processing executed by a gaming system.

Notification unit 16 is a unit for providing a notification of a balance of electronic money. Notification unit 16 acquires balance information stored in server device 200 to notify it to a user by an image or voice. Notification unit 16 may make a notification in response to a user's request or a user's input operation, or may display a balance whenever displaying a predetermined screen such as an initial screen of an e-shop. Notification unit 16 may notify a user of an ad of a product or service available in an e-shop, instead of or in addition to a balance of electronic money FIG. 7 is a flowchart showing an example processing executed in gaming system 100 in response to electronic money charging. A series of processing of steps SA1 to SA7 and SA13 is hereinafter referred to as "charge sequence," and a series of processing of steps SA8 to SA12 is hereinafter referred to as "game sequence." Control unit 110 of gaming system 100 initially causes display unit 161 to display a predetermined input screen in response to a user's input operation (step SA1). A user who wishes to charge electronic money performs an input operation to display the input screen. Control unit 110 may display the input screen by suspending a running game processing of a mini game.

Figure 8:
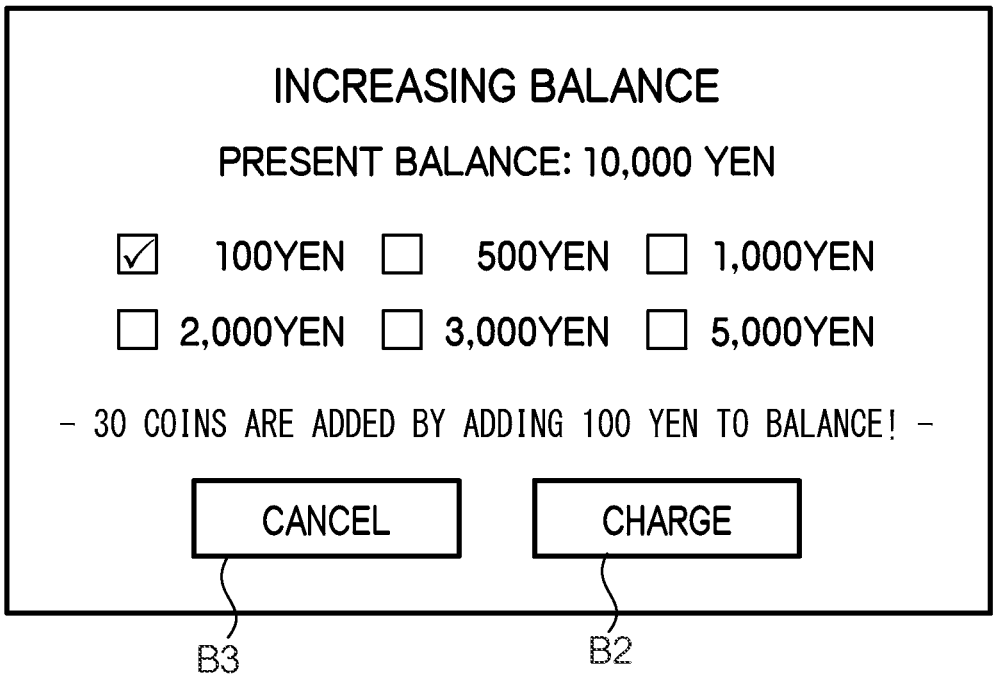
FIG. 8 shows an example of an input screen.

FIG. 8 is a diagram showing an example of the input screen. As shown in the example, control unit 110 causes display unit 161 to display a current balance of electronic money usable in an e-shop, and candidate charge amounts. Control unit 110 may reject charging that would cause a balance of electronic money to exceed an upper limit. Control unit 110 may cause display unit 161 to display the number of coins to be obtained in exchange for a user-selected charge amount.

Control unit 110 causes display unit 161 to display the input screen to receive a charge amount input (step SA2). Control unit 110 performs processing of step SA3 and subsequent steps in response to a user's selection of charge button B2 shown in the input screen, and cancels charging in response to a user's selection of cancel button B3.

Control unit 110, at step SA3, tries to establish communication with IC card 400, and determines whether communication with IC card 400 has succeeded. Meanwhile, a user locates IC card 400 within a communication range of second communication unit 140. Control unit 110 continuously performs the determination until communication with IC card 400 succeeds. Control unit 110 may perform a predetermined error handling and cancel charging if communication with IC card 400 has continuously failed at least a predetermined number of times, or for at least a predetermined time period.

After establishing communication with IC card 400, control unit 110 reads a balance of IC card 400, or specifically an amount of electronic money recorded in IC card 400, and determines whether the balance equals or exceeds the charge amount (step SA4). When the balance of IC card 400 is less than the charge amount, control unit 110 performs a predetermined error handling and cancels charging (step SA13). The error handling of step SA13 may notify a user that IC card 400 has an insufficient balance, and that proceeding with charging requires increasing the balance of IC card 400.

On the other hand, when the balance of IC card 400 equals or exceeds the charge amount, control unit 110 transfers electronic money of the charge amount input at step SA2 from the balance of IC card 400 to a balance of an e-shop (step SA5). Control unit 110 also subtracts the same amount as the charge amount from the balance of IC card 400 to keep the total amount of electronic money the same.

After adding the charge amount to the balance of the e-shop, control unit 110 adds the number of coins according to the charge amount (step SA6). Control unit 110, in the present example embodiment, adds 30 coins per charge of 100 yen. The number of coins determines the number of times a user is able to play a mini game.

Control unit 110 permits execution of a game processing of a mini game in response to the addition of coins due to the charging (step SA7). Control unit 110 subsequently determines whether to execute a game processing, on the basis of a user's input operation (step SA8). To do so, control unit 110 inquires whether a user is to play the mini game, and prompts him/her to make a selection.

A user who wishes to play the mini game performs a predetermined input operation. Control unit 110 that has received the input operation determines whether a coin is present (step SA9). When the total number of coins is one or more, control unit 110 decrements the total number (step SA10) and executes a game processing of the mini game (step SA11). Control unit 110 performs the processing of steps SA8 to SA11 and decrements the number of coins for each play of the mini game. The number of coins usable for the mini game may be recorded as user information described above.

Control unit 110 prohibits execution of a game processing of the mini game after repeated playing of the mini game exhausts all coins (step SA12). As a result, a user is prevented from playing the mini game before performing further charging.

It is to be noted that the charge sequence and the game sequence may be carried out separately. A user may play the mini game sometime after charging, without playing it immediately after the charging. Control unit 110 may execute only the charge sequence, and execute the game sequence in response to a user's input operation to start the mini game.

As described in the foregoing, the present exemplary embodiment enables a user to play a mini game in exchange for electronic money charging. The present exemplary embodiment enables a user to play a mini game, without consuming electronic money, which causes a user to feel free to play a mini game just to pass time.

Information-processing system 10 is able to motivate a user to charge electronic money. Information-processing system 10 is able to motivate even a user who lacks a clear objective of purchasing a specific product or service to charge electronic money. In other words, information-processing system 10 has an effect of reducing a user's psychological barrier or resistance to charging electronic money.

Further, prompting a user to preliminarily increase a balance has an effect of preventing a situation from occurring that reduces user's concentration on a game contrary to his/her wishes. The situation may include forcing a user, who is playing a game that consumes electronic money while being played, to suspend the game to charge electronic money due to an insufficient balance.

[Modifications]

The above exemplary embodiment is merely an example of possible embodiments. The above exemplary embodiment is not intended for limited interpretation. The above exemplary embodiment may be modified as described below. Any two or more of the following modifications may be combined with each other.

(Modification 1)

A mini game described above may be replaced with a game available in an e-shop or a trial version thereof. A trial version refers to a game available in an e-shop with predetermined limitations imposed, which only allows a user to play some stages of the game, or to play the game with limited functions. Playing a trial version provides a user with information for deciding whether to purchase a full-version game. A user allowed to play a game available in an e-shop may be subjected to certain limitations such as a limitation on a time period for downloading or playing the game.

A mini game may have basic functions that can be used for free and other functions that can be added or enabled by consuming electronic money. A user playing such a mini game may spend electronic money to proceed with the game under favorable conditions (e.g., a right to use a powerful item may be granted), although s/he may play a mini game without spending electronic money.

Balance control unit 15 may vary an amount of money required to add or enable such a paid function, for different conditions of execution of a mini game such as a play time, the number of plays, or a result of play. Balance control unit 15 may discount a larger amount of money required to add or enable a paid function in proportion to the number of stages of a mini game played by a user. Balance control unit 15 may alternatively provide the paid function for free to a user who has satisfied a predetermined condition in a mini game.

A mini game according to the above exemplary embodiment may be played a number of times not proportional to a charge amount. A mini game may be played an unlimited number of times when cumulative charge amounts reach a predetermined total, or when a cumulative number of charges reaches a predetermined number. The game may alternatively be played an unlimited number of times for only one charge.

(Modification 2)

In the above exemplary embodiment, playing the mini game requires a coin, which is given in response to charging. Thus, control unit 110 may determine whether charging has been received with reference to presence or absence of a coin. It is to be noted that a mini game may be a game not using a coin.

A game processing of a mini game may be prohibited in a situation where no electronic money charging has been performed. To realize the modification, control unit 110 may manage a flag indicative of whether to permit execution of a mini game, and update the flag to make a game processing of the mini game executable on receipt of a charge.

(Modification 3)

In the above exemplary embodiment, where electronic money usable in IC card 400 and electronic money usable in information-processing system 10 may be electronic money for different payment systems, the two types of electronic money may be electronic money for a common payment system. Namely, a charging herein may refer to an electronic money transfer without a change of payment systems.

(Modification 4)

A medium according to the above example embodiment, which is an electronic-payment-enabled medium, may perform communication using a method other than NFC. IC card 400 and second communication unit 140 may be replaced with a contact-type IC card and an interface thereof. Alternatively, charging according to the above exemplary embodiment may be performed in response to an input of a character string printed on a prepaid card purchased by a user, or in response to an input of a credit card number. In other words, electronic money may be purchased with cash. A medium according to the above exemplary embodiment may include a prepaid card and a credit card. A medium according to the above exemplary embodiment may be of a shape other than card-type. A medium according to the above exemplary embodiment may be replaced with an electronic device having an electronic money function such as a smartphone.

Electronic money may be associated with a device, or specifically gaming system 100, instead of a user, or specifically a user account. This modification enables plural users, such as a family using an identical device, to share charged electronic money.

The above exemplary embodiment can be applied to a case of charging electronic money in a medium such as an IC card. Specifically, the above exemplary embodiment may provide a computer device that permits execution of a game processing in response to a charging of electronic money in an IC card usable in a payment system. The computer device may be without a unit equivalent to second communication unit 140, in contrast to gaming system 100.

(Modification 5)

Notification unit 16 may notify a user of an ad for a product or service available in an e-shop in accordance with a balance. Notification unit 16 may, specifically, omit displaying an ad when a user's balance in an e-shop is less than a predetermined amount, and may display an ad when the balance equals or exceeds the predetermined amount. Notification unit 16 may alternatively notify a user of different ads for different balances.

(Modification 6)

Gaming system 100 according to the above exemplary embodiment is an example of an information-processing device. The information-processing device may be a device other than a game machine such as gaming system 100. The information-processing device may be a general-purpose computer device such as a personal computer. This modification eliminates the need for games other than a mini game.

The information-processing device may alternatively be a portable electronic device, or specifically a mobile communication terminal such as a tablet terminal or a smartphone. The information-processing device, in such a modification, may include an electronic-payment-enabled medium such as a radio frequency (RF) tag. The information-processing device may alternatively be a portable game machine or a portable music player.

The configuration shown in FIG. 6 may be provided by a single device in the above exemplary embodiment. Alternatively, game control unit 12 and game execution unit 13 may be provided by different devices. In other words, a unit that controls execution of a game processing and a unit that executes the game processing may be provided in different devices. Specifically, part or all of a game processing executed by game execution unit 13 may be executed at a server side, as in the case of a browser game. In such a case, game control unit 12 may make a game processing executable by notifying a user of a uniform resource locator (URL) of a Web page for playing a browser game.

The above exemplary embodiment provides, in addition to an example of an information-processing device or information-processing system, an example of an electronic money charging method enabled by the device or system. Part or all of the functions according to the above exemplary embodiment may be provided in the form of a program. The program may be provided to an information-processing device via a storage medium such as an optical disk or a semiconductor memory, or may be downloaded to an information-processing device via a network such as the Internet.

What is claimed is:

1. An information-processing system, comprising:

an electronic storage device configured to store a first game process, the first game process being a trial version of a video game that is provided in a game application program;

a processing system that includes electronic memory and at least one processor comprising electronic circuitry, the processing system programmed to:

process a first input provided by a user, the first input associated with an amount value, based on the first input provided by the user, increase a balance value by the amount value, control authorization to permit execution of the first game process based on the increase in the balance value, wherein the execution of the first game process is prohibited prior to the increase in the balance value and the authorization to execute the first game process does not cause a decrease to the balance value, execute the first game process while access to the first game process is authorized and accept input provided from the user to play the trial version of the video game, and based on a second input which indicates selection of a second game process, decrease the balance value by a second amount value, control authorization to permit execution of the second game process and execute the second game process, wherein the second game process is a full version of the video game provided in the game application program, the full version of the video game includes game functionality omitted from the trial version of the video game, and execution of the second game process permits the user to play the full version of the video game.

2. The information-processing system according to claim 1, wherein the first game process is made executable in response to indication that the balance value is increased by the amount value.

3. The information-processing system according to claim 2, wherein the second game process is made executable in response to indication that the balance value is decreased by the second amount value.

4. The information-processing system according to claim 1, wherein the first game process becomes executable in response to receipt of a charge performed in accordance with the amount value.

5. The information-processing system according to claim 1, wherein the first input is further based on an electronic-money-enabled medium.

6. The information-processing system according to claim 5, further comprising a transceiver configured to communicate with the electronic-money-enabled medium in connection with the first input.

7. The information-processing system according to claim 1, wherein the balance value is associated with an account for the user, a device, and/or a medium, and the amount value is directed to the account.

8. The information-processing system according to claim 1, wherein the first game process is associated with an executable time period or an executable number of times in which the trial version of the video game may be played by the user, and the executable time period or the executable number of times is increased in proportion to the amount value in which the balance value is increased.

9. The information-processing system according to claim 1, wherein the processing system is further configured to grant a bonus to the user in accordance with a result of the first game process.

10. The information-processing system according to claim 9, wherein the bonus does not increase or decrease the balance value.

11. The information-processing system according to claim 1, wherein the first game process comprises a function that is added or enabled based on consumption of the balance value, and an amount of consumption required to add or enable the function varies according to different conditions of execution of the first game process.

12. The information-processing system of claim 1, further comprising:

a transceiver configured to communicate with a remove server, wherein the processing system is further configured to communicate via the transceiver, in accordance with selection of the second game process, a purchase request to a server computer system for the game application program, and the balance value is decreased based further on the purchase request.

13. The information-processing system of claim 1, wherein the first game process is downloaded from a server, and stored in the electronic storage device, when the balance value is increased by the amount value.

14. The information-processing system of claim 1, wherein the first game process is pre-stored in the electronic storage device and is not executable until the balance value is increased by the amount value.

15. The information-processing system of claim 1, wherein the processing system is further programmed to impose a time limitation, for downloading or playing the trial version of the video game, based on the first input.

16. The information-processing system of claim 1, wherein the processing system is further programmed to impose a number of access times limitation, for downloading or playing the trial version of the video game, based on the first input.

17. The information-processing system of claim 1, wherein the processing system is further programmed to notify the user of an ad for a product or service when the balance value exceeds a predetermined amount.

18. The information-processing system according to claim 1, wherein the first game process is associated with an executable time period or an executable number of times in which the trial version of the video game may be played by the user, the programming system is further programmed to:

process a plurality of first inputs provided by the user, each first input being a separate charge associated with an amount value; and based on the plurality of first inputs, increase the balance value by each amount value associated with the charges of the plurality of first inputs, and the executable time period or the executable number of times is increased in proportion to a number of charges, corresponding to the plurality of first inputs, in which the balance value is increased.

19. An information-processing device, comprising:

an electronic storage device configured to store a first game process, the first game process being for a mini game that is playable upon being granted authorization to play the mini game;

at least one hardware processor that is coupled to electronic memory storing computer executable instructions, the at least one hardware processor is programmed, via the computer executable instructions, to:

process a first input provided by a user, the first input associated with an amount value, based n the first input provided by the user, increase a balance value by the amount value, set a flag that controls authorization to execute the first game process based on the increase in the balance value, wherein the execution of the first game process is prohibited prior to the increase in the balance value and the set flag and the authorization to execute the first game process does not cause a decrease to the balance value, execute the first game process while access to the first game process is authorized based on the set flag and accept input provided from the user to play the mini game, based on a second input, select a second game process being for a game application program that includes different game functionality than the first game process, and based on selection of the second game process, decrease the balance value by a second amount value, control authorization to permit execution of the second game process and execute the second game process, wherein the mini game of first game process has less gameplay functionality in comparison to functionality provided by the game application program, execution of the second game process permits the user to play the game application program, and the execution of the second game process is prohibited prior to the decrease in the balance value.

20. The information-processing device of claim 19, wherein the first game process is a trial version of the game application program.

21. A non-transitory computer readable storage medium storing a program for use with a computer that includes at least one hardware processor coupled to electronic memory, the stored programed comprising instructions that cause the computer to:

store a first game process in an electronic storage device of the computer, the first game process being for a mini game that is playable by a user upon being granted authorization to play the mini game, and the mini game including gameplay functionality that is restricted in comparison to gameplay functionality that is offered via a game application program;

process a first input provided by a user, the first input associated with an amount value;

based go the first input provided by the user, increase a balance value by the amount value;

control authorization to execute the first game process based on the increase in the balance value, wherein the execution of the first game process is prohibited prior to the increase in the balance value and the authorization to execute the first game process does not cause a decrease to the balance value;

execute the first game process while access to the first game process is authorized and accept input provided from the user to play the mini game;

based on a second input, select a second game process, the second game process being for the game application program and the second game process including different game functionality than the first game process; and based on selection of the second game process, decrease the balance value by a second amount value, control authorization to permit execution of the second game process and execute the second game process, wherein execution of the second game process permits the user to play the game application program, and the execution of the second game process is prohibited prior to the decrease in the balance value.

22. A method of authorizing access to digital content, the method comprising:

storing, in an electronic storage device, a first game process, the first game process being a trial version of a video game that is provided in a game application program;

processing a first input provided by a user, the first input associated with an amount value;

based on the first input provided by the user, increasing a balance value by the amount value;

controlling authorization to execute-a permit execution of the first game process based on the increase in the balance value, wherein the execution of the first game process is prohibited prior to the increase in the balance value and the authorization to execute the first game process does not cause a decrease to the balance value;

executing the first game process while access to the first game process is authorized and accepting input provided from the user to play the trial version of the video game; and based on a second input which indicates selection of a second game process, decreasing the balance value by a second amount value, controlling authorization to permit execution of the second game process and executing the second game process, wherein the second game process is a full version of the video game provided in the game application program, the full version of the video game includes game functionality omitted from the trial version of the video game, and execution of the second game process permits the user to play the full version of the video game.

* * * * *